US005265279A

United States Patent [19]

Mathis

[11] Patent Number: 5,265,279

[45] Date of Patent: Nov. 30, 1993

[54] LINER FOR PROTECTIVE HEAD COVERINGS

[76] Inventor: Richard M. Mathis, P.O. Box 1221, Vernal, Utah 84078

[21] Appl. No.: 953,998

[22] Filed: Sep. 29, 1992

[51] Int. Cl.[5] ..... A42B 3/12

[52] U.S. Cl. ..... 2/181; 2/DIG. 11

[58] Field of Search ..... 2/63, 181, 181.2, 182.1, 2/182.2, 185 R, 190, 199, 410, 416, 425, DIG. 11

[56] References Cited

U.S. PATENT DOCUMENTS 4,468,817 9/1984 Nunnery et al. ..... 2/181

5,088,126 2/1992 Mathis ..... 2/181

OTHER PUBLICATIONS

Safety Supply House of Louisiana showing Terri-Band Comfort Band for Industrial Headgear.

*Primary Examiner*—Clifford D. Crowder

*Assistant Examiner*—Diana L. Biefeld

*Attorney, Agent, or Firm*—Mallinckrodt & Mallinckrodt

[57] ABSTRACT

A removable liner for lining a forehead-contacting portion of a headgear of a protective head covering such as a hard hat includes a piece of material configured with a bottom edge, side edges extending outwardly and upwardly from the bottom edge to a top edge, and a top edge with top edge end portions sloping upwardly to a central top edge portion. Fastening means, such as snaps, are provided at the ends of and intermediate the top edge of the liner with respective mating fastening means at the ends of and intermediate the bottom edge so that the liner can be folded around the forehead-contacting strap and flap and the fastening means fastened to hold the liner in position. The fastening means along the bottom edge of the liner are all offset inwardly or toward one another from their respective mating fastening means along the top edge so as to provide a good fit around the strap and flap with a minimum of bunching and wrinkling. In one embodiment, bottom edge end portions are concavely curved to provide a better fit.

15 Claims, 4 Drawing Sheets

LINER FOR PROTECTIVE HEAD COVERINGS

BACKGROUND OF THE INVENTION

1. Field

The present invention relates generally to liners or sweatbands for use with safety equipment and more specifically to the forehead contacting portions of the supporting headgear of a hard hat or similar head protection.

2. State of the Art

Hard hats are well known in construction, manufacturing, and many other industries. Standard hard hats comprise a metal or hard plastic shell, which generally conforms to the shape of a wearer's head; and supporting headgear therein which forms a suspension system attached to the inner concave portion of the shell, and which is fitted to and supports the shell on the wearer's head. Various other types of head protection such as welding helmets and face shields have similar headgear.

The headgear or suspension system is usually made up of a number of flexible straps to fit over the head inside the shell and a strap which fits snugly about the circumference of the head extending across the forehead and around the back of the head. Normally, a flap or covering of soft plastic with a foam material is placed between the plastic strap and the wearer's forehead to provide some cushion and make the headgear more comfortable to wear.

While the above-described hard hat or other head protection is quite effective in terms of safety and utility, it has been found lacking in comfort. For example, many who wear hard hats on a consistent basis must do so in less than ideal temperature environments. Steel workers often work under extremely high temperature conditions, while construction workers must face high temperatures outdoors in the summer or in hot climates and extremely low temperatures when working outdoors during winter in cold climates. Because the soft plastic used in the flap portion of the headgear which contacts the wearer's forehead is non-porous, non-absorbent, and a poor insulator, it cannot absorb sweat or insulate from the cold. As a result, the wearer suffers discomfort.

An additional source of discomfort may be a flap's limited ability to cushion the forehead from irregularities in the otherwise smooth surface of the enclosed or covered strap. When a hard hat must be worn for hours at a time, even the slightest protrusion can be detected and cause much discomfort. Often, slight protrusions are built into the enclosed plastic strap in the form of connection joints for the fabric suspension straps.

My U.S. Pat. No. 5,088,126 shows a disposable liner for the forehead contacting portions of the headgear of a protective head covering which is adhered to the forehead contacting surface of the forehead contacting flap of such headgear. The liner is removed and replaced with a new liner when desired by the user.

It has been found that some users prefer a reusable liner which can be removed from the forehead contacting flap, washed, and then replaced. U.S. Pat. No. 4,468,817 shows a liner or perspiration band for headgear comprising a rectangular strip of terry cloth material with snaps spaced along the top and bottom longitudinal edges thereof so that the material can be wrapped around the forehead contacting flap, and strap to which it is attached, of a headgear and snapped together to be held in place around such strap. The patent also shows a variation of the liner having cut-out notches along the top longitudinal side of the strip. The patent states that the rectangular strip fits a four strap headgear band and the strip with cut-out notches fits a six strap headgear band.

A commercial version of the sweatband shown in U.S. Pat. No. 4,468,817 is currently available from Safety Supply House in Belle Chasse, La. It differs from the band shown in U.S. Pat. No. 4,468,817 in that the ends of the rectangular strip angle outwardly toward the top of the strip and a rounded flap is provided extending from the central portion of the upper edge of the strip. However, in use, it has been found that such band does not fit headgear as well as it might and produces uncomfortable bulges and wrinkles.

SUMMARY OF THE INVENTION

According to the invention, a liner is provided to be removably secured around the forehead contacting portion or flap of a strap of the headgear of protective head covering apparatus, such as hard hats, to cushion the contact with the forehead and provide for sweat absorption and insulation to thereby increase the comfort in wearing of the protective head covering apparatus. The liner includes a piece of absorbent, cushioning material, such as terry cloth or synthetic, sponge backed, fabric material specially configured to fit around the forehead contacting flap and the strap to which such flap is secured with minimal bulging and wrinkling so as to provide a comfortable liner which can be easily removed for washing and then replaced for further wear. The cushioning material has a bottom edge with opposite ends, with side edges extending upwardly and outwardly from the bottom edge ends to form bottom end corners and, at the top of each side edge, to form the ends of a top edge and top edge corners. End portions of the top edge slope upwardly from each top edge end corner and has a rounded concave section sloping up to a substantially straight top edge central portion. The top edge central portion is shorter than the top edge end portions. Also the top edge central portion is substantially parallel to the opposite bottom edge central portion. End fastening means, such as snap halves, are secured to the cushioning material adjacent the top end corners while mating fastening means, such as mating snap halves, are secured to the cushioning material adjacent the bottom end corners. In this way the bottom end corners can be secured to the top end corners to hold the material around a headgear strap.

Top intermediate fastening means, such as snap halves, are also positioned along the top edge central portion adjacent top central portion ends formed where the top edge central portion meets the top edge end portions, which mate with mating bottom intermediate fastening means, such as mating snap halves, located along the bottom edge intermediate the bottom edge ends and between lines perpendicular to the bottom edge and passing through the top intermediate fastening means, preferably through the center of such fastening means. It has been found preferable to locate the bottom intermediate fasteners just inside the perpendicular lines when such lines pass through the centers of the top intermediate fasteners. Such mating fastening means hold the intermediate portions of the strip around the headgear strap. It has been found that the fit of the strip is improved in some cases by providing smoothly concave curved end portions in the bottom edge of the strip between the bottom edge ends and a bottom edge central portion including the length of the bottom edge between the perpendicular lines passing through the top intermediate fastening means.

THE DRAWINGS

In the drawings, which illustrate the best mode presently contemplate for carrying out the invention in actual practice:

FIG. 1 is a bottom perspective view of a hard hat showing the normal headgear with forehead contacting flap and strap;

FIG. 2, a fragmentary vertical section taken on the line 2—2 of FIG. 1 and additionally showing a liner of the invention installed around the forehead contacting flap and strap;

FIG. 3, a front elevation of a piece of material cut for use as a liner of the invention;

FIG. 4, a front elevation similar to that of FIG. 3, and showing a completed liner of the invention; and FIG. 5, a front elevation similar to that of FIG. 4, but showing a different embodiment of the liner.

DETAILED DESCRIPTION OF THE ILLUSTRATED EMBODIMENT

Figure 1:
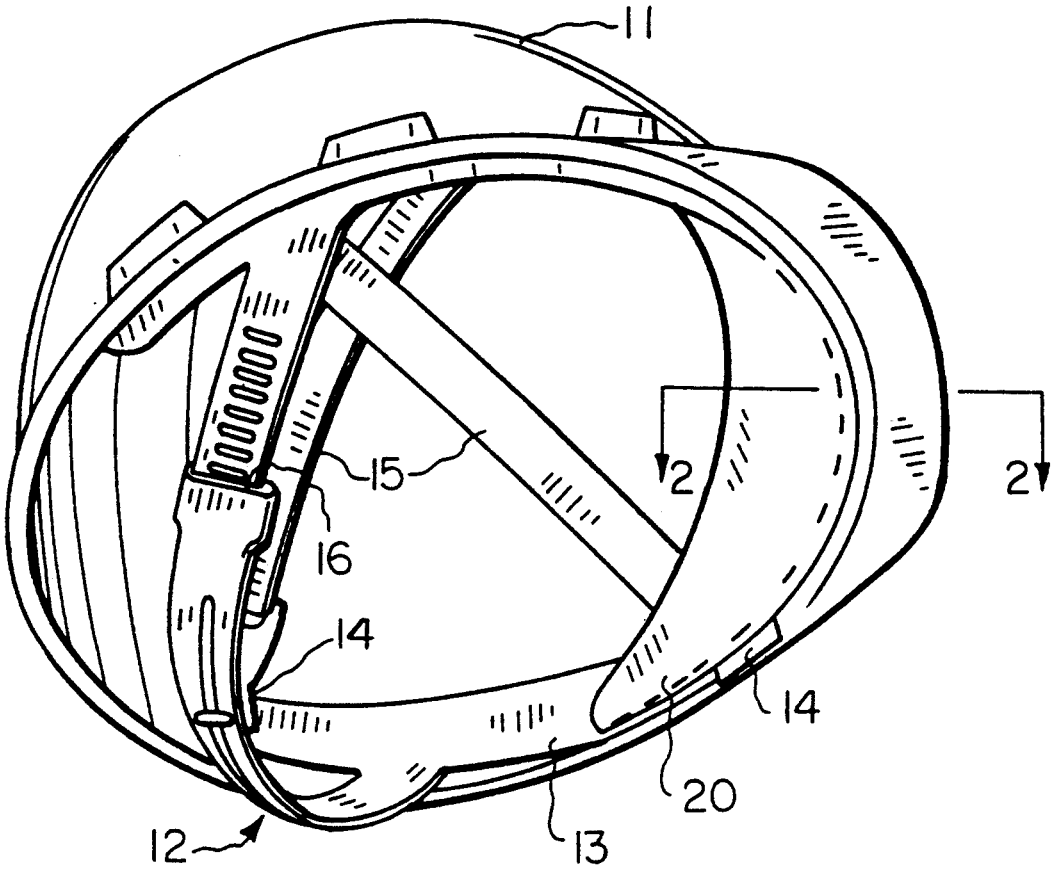
FIG. 1 (PRIOR ART)
Figure 2:
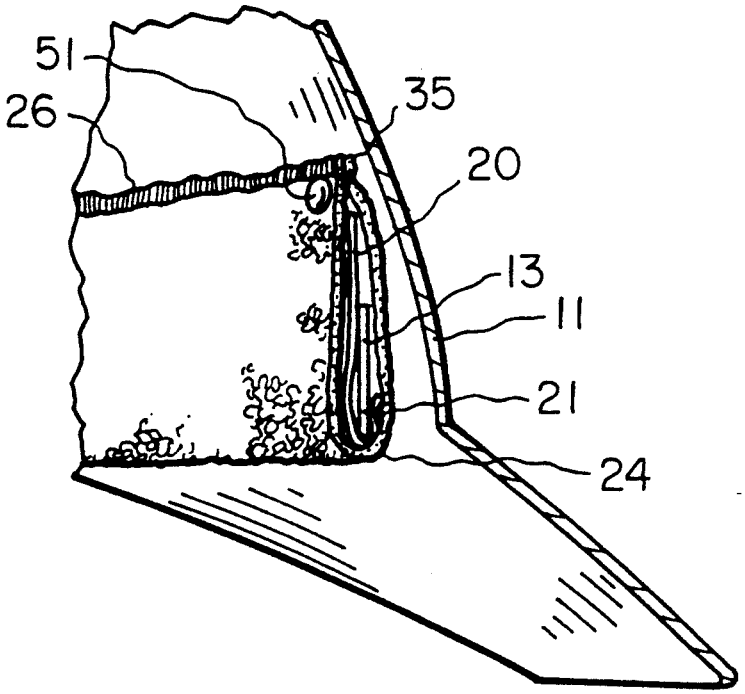

As shown in FIGS. 1 and 2, the normal hard hat includes a protective hard shell 11 which is supported on a wearer's head by headgear 12 mounted inside the shell 11. The headgear 12 generally includes a strap 13 which is attached to the shell at several points as by resilient hinges 14 and extends around a wearer's head, and straps 15 with ends secured to strap 13 or to the attachment hinges 14 to extend over the top of the user's head to support the shell 11 thereover. The strap 13 generally has provisions for size adjustment, as at 16, so the strap can be sized to fit snugly around the forehead, sides, and back of the wearers head, above the ears, to hold the hat securely on the wearer's head. Since strap 13 extends snugly about the wearer's head, it is usually configured to fit comfortably against the users head, particularly across the users forehead. For this purpose, the front portion of strap 13 usually has a forehead contacting flap 20 secured to the outer side thereof, such as by stitching 21, and folded around the bottom of strap 13 approximately 180° to extend upwardly over the inner forehead contacting surface thereof. This forms a forehead contacting flap surface. The flap 20 is usually made of a foam backed plastic material to provide cushioning for the wearer's forehead.

While the foam backed plastic material usually used for flap 20 is an improvement over merely having strap 13 contact the forehead, since it is a plastic surface which contacts the forehead, it does not absorb perspiration, and, in cold weather, it is cold when placed against the head. The invention provides a removable liner 24 to be secured around flap 20 and strap 13 to provide a more comfortable, perspiration absorbing and insulating surface to contact the forehead. Since the liner is provided to absorb perspiration, the liner must be easily removable and replaceable so that, particularly when used in hot environments, it can be removed, washed, and replaced regularly and frequently.

Figure 3:
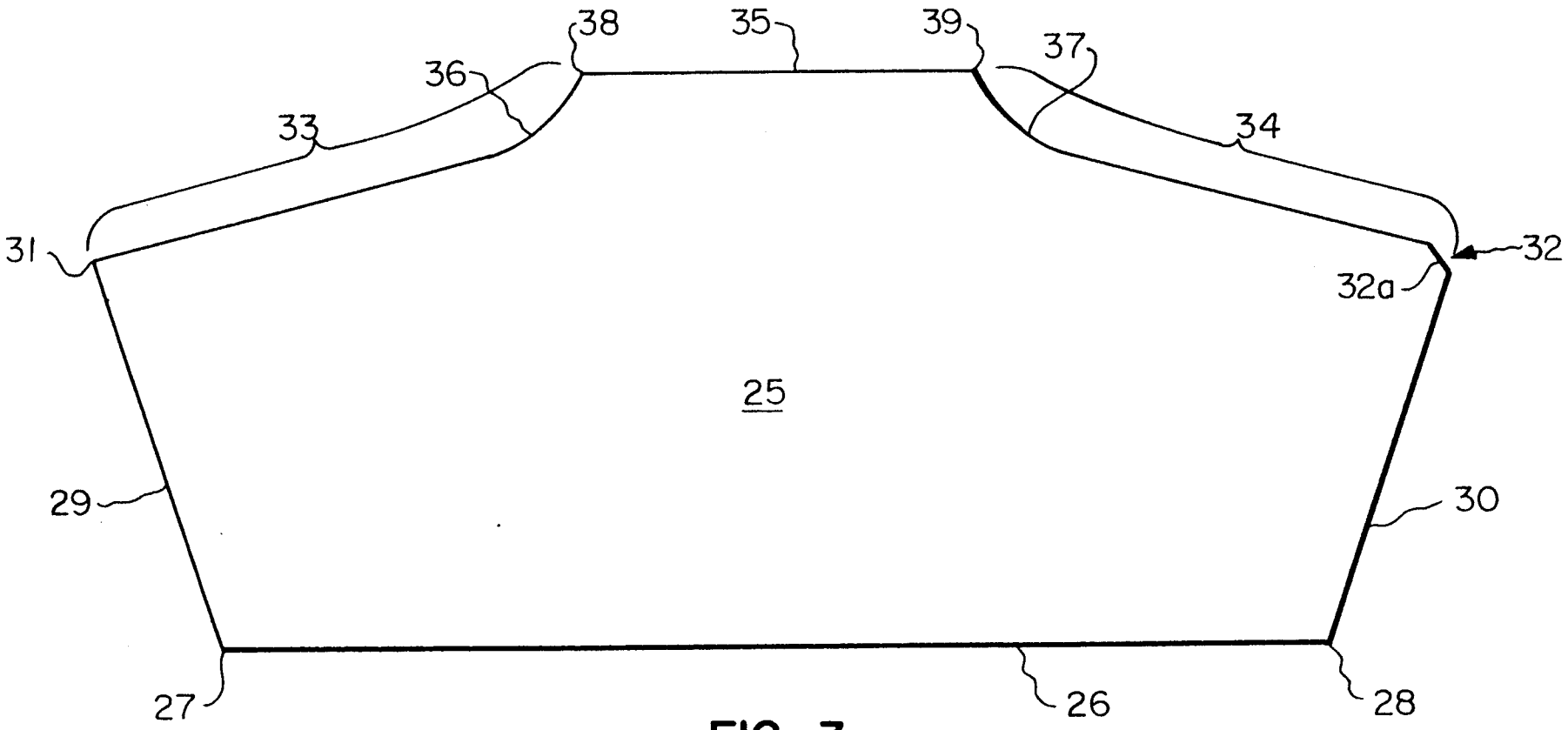

The preferred embodiment of the liner 24 of the invention comprises a piece of terry cloth or other absorbent material 25, FIG. 3, cut to a size and shape to allow it to be easily folded around strap 13 and flap 20, as shown in FIG. 2. In a preferred form of the invention, material 25, FIG. 3, has a straight bottom edge 26 with opposite bottom edge ends 27 and 28. A straight side edge 29 extends upwardly and outwardly from the bottom edge end 27 to form a bottom end corner at bottom edge end 27, while straight side edge 30 extends upwardly and outwardly from the bottom edge end 28 to form an opposite bottom end corner at bottom edge end 28. Since the bottom end corners are formed at bottom edge ends 27 and 28, reference numbers 27 and 28 also designate such bottom end corners. Side edges 29 and 30 extend upwardly to meet with top edge ends 31 and 32 and form opposite top end corners at the top edge ends 31 and 32. Again, since the top end corners are formed at top edge ends 31 and 32, reference numbers 31 and 32 also designate such top end corners. Opposite top edge end portions 33 and 34 extend from top edge ends 31 and 32, respectively, to a top edge central portion 35 to complete the top edge of the liner 24 and of material 25. Top edge end portions 33 and 34 slope upwardly from the top edge ends 31 and 32, respectively, and each includes a rounded concave section 36 and 37, respectively, curving upwardly to the top edge central portion 35, at top edge central portion ends 38 and 39, respectively. Top edge central portion 35 is substantially straight and parallel to the opposite bottom edge 26. It is also shorter than the top end portions.

Figure 4:
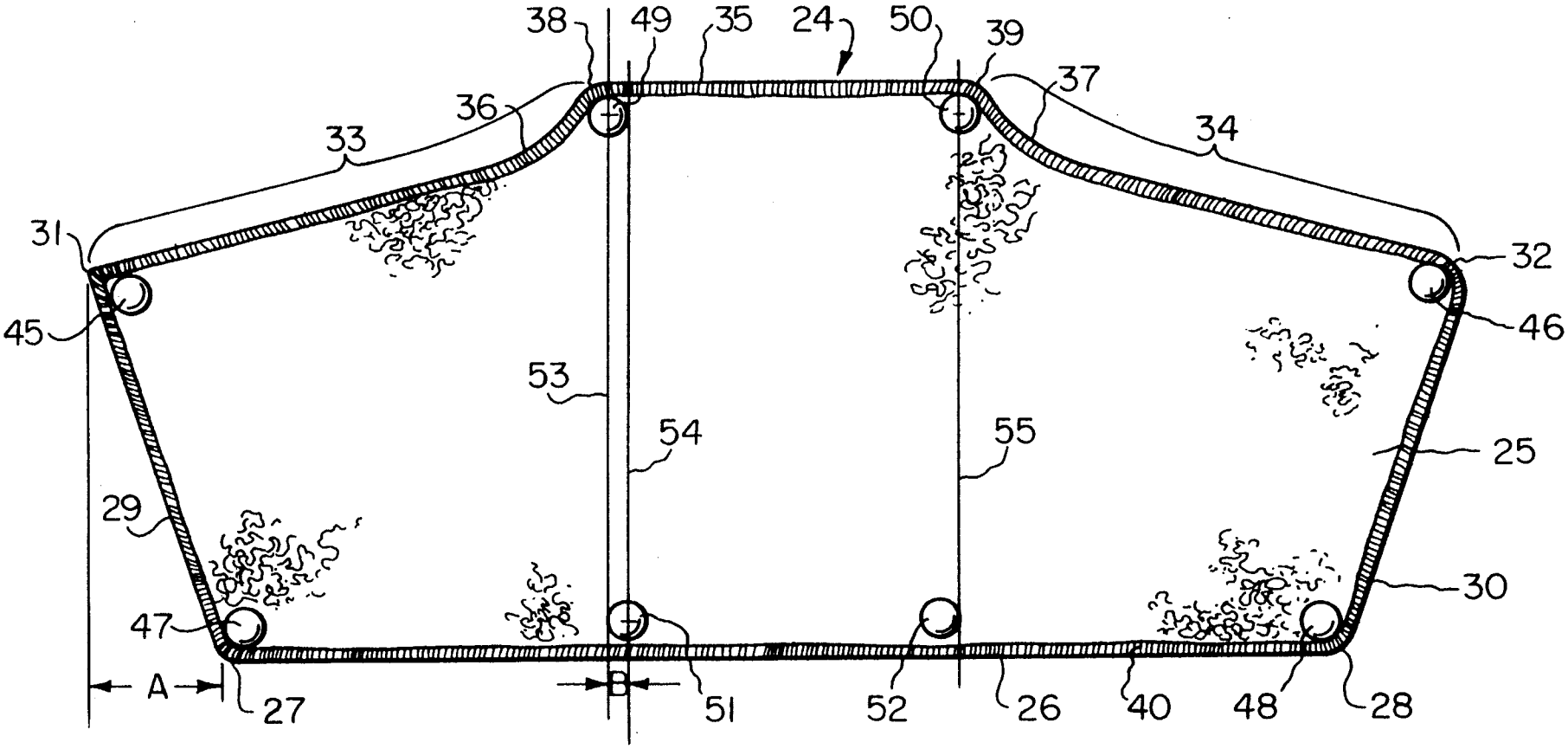
Figure 5:
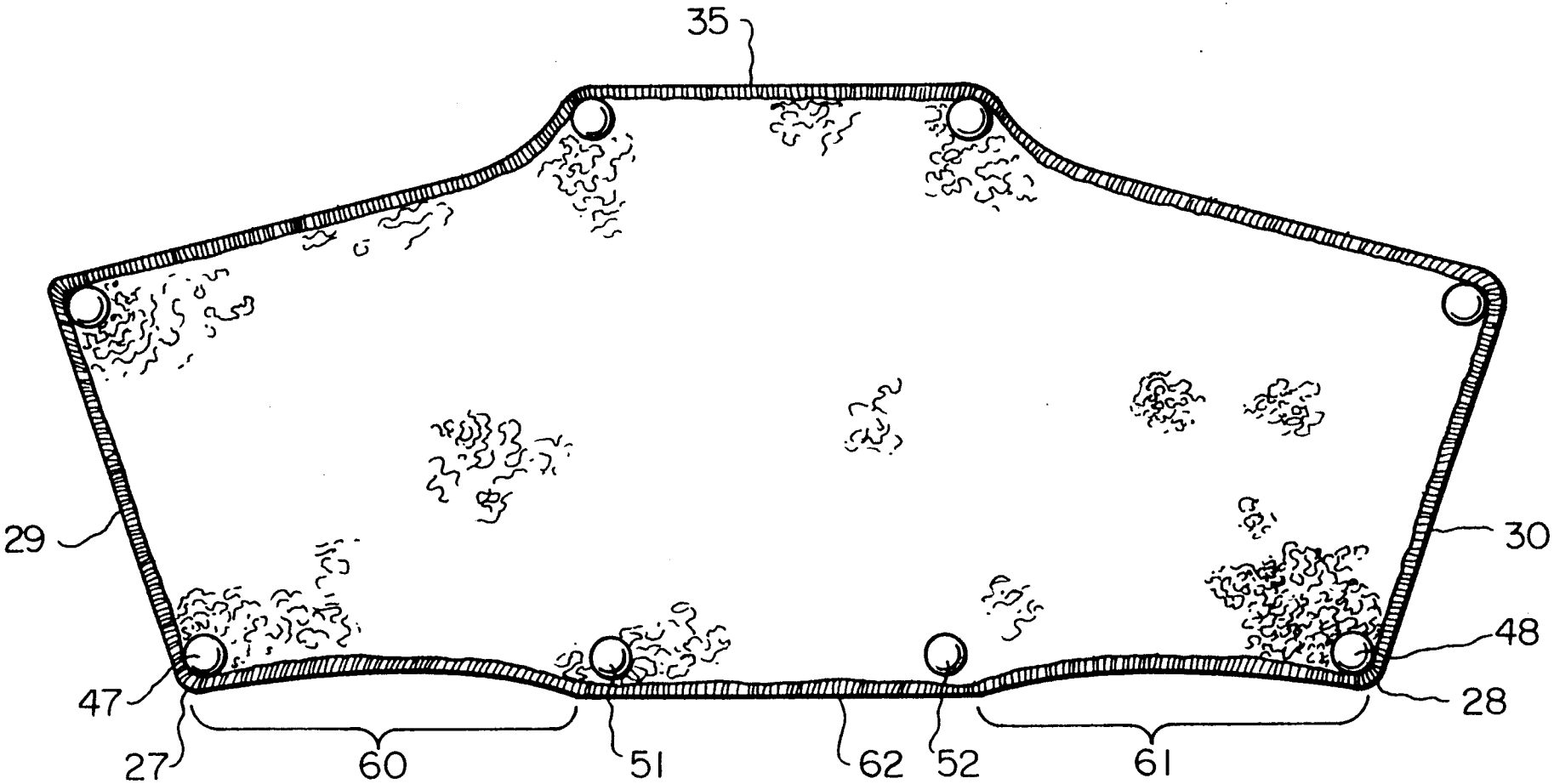

When using a terry cloth or similar material, the edges are preferably surged to provide a border 40, FIG. 4, to prevent fraying of the material, particularly during repeated washing and handling. The surging rounds the corners of the material of the finished liner as can be seen in FIG. 5.

With the configuration of material as shown in FIG. 3, surging is continuous around the material and preferably starts at top edge end 31 and continues along the top edge, around top edge end 32, which is cut with flat portion 32*a*, FIG. 3, to prevent a sharp corner angle of greater than 90° specifically to accommodate the surging and prevent excessive bulging of material at corner 32, then down side edge 30, around corner 28, across bottom edge 26, around corner 27, and along side edge 29 to the point of beginning.

While dimensions may vary to some extent depending upon the model headgear to be fitted, in the preferred embodiment of the invention for use with MSA and similar model hard hat headgear, the side edges extend outwardly from bottom to top a distance A, FIG. 4, of about one and one-eighths inch. For that particular embodiment, the total length of the side edges is about three and three-quarter inches, giving a total height of the material at the top corner of about three and one-half inches. The total height between the straight top edge central portion and opposite bottom edge central portion is about five and one-eighths inches. Overall length between the top end corners is about twelve inches, and between the bottom end corners is about nine and three-quarter inches.

Fastening means, such as mating snap halves, are provided at the corners of the liner. Thus, snap halves 45 and 46 may be located adjacent top end corners 31 and 32, respectively, while mating snap halves 47 and 48 are located adjacent bottom end corners 27 and 28, respectively. The offset of distance A between the bottom corners and top corners, and approximate similar offset of mating snap halves, has been found necessary to avoid bunching of the ends of the liner when secured in position around the headgear strap. Such bunching occurs if the mating snap halves or other fasteners are approximately in line. This offset between the mating snap halves should be over about an inch and preferably about the one and one-eighth inch offset of the top and bottom corners. This offset means that the fasteners along the bottom edge are closer together than the fasteners along the top edge. The sloping top edge end portions with the top edge central portion has also been found necessary to prevent bunching of the liner and to provide a good fit around the headgear strap and forehead contacting flap.

Fastening means, such as snap halves 49 and 50, are positioned along top edge central portion 35 adjacent top edge central portion ends 38 and 39, respectively, while respective mating snap halves 51 and 52 are provided along the bottom edge intermediate its length. Again, placement of the mating fastening means or snap halves is important for a good fit of the liner, and the fastening means along the bottom edge should be positioned more closely together than the fastening means adjacent the top edge central portion ends. In the preferred embodiment described, a line 53 may be drawn through the center of upper fastening means 49 perpendicular to bottom edge 26 (line 53 is also perpendicular to the edge of the top central portion). The bottom mating fastening means 51 is offset from line 53 so that it is located inwardly of line 53, preferably with its edge just touching the inside of line 53. For snap halves, this provides an offset, B, of one half the width of the fastening means, or, with the preferred snap fasteners, of about one-quarter inch (distance between line 53 and a parallel line 54 drawn through the center of fastening means 51 perpendicular to bottom edge 26). Mating top and bottom fasteners 50 and 52 are similarly located with respect to a line 55.

In use, the liner is wrapped around the headgear strap 13 and flap 20 as shown in FIG. 2, with the bottom edge 26 being inside or next to the forehead of a wearer and the top edge being wrapped around the outside of strap 30, i.e., between strap 30 and the hard hat 11 or other protective headgear, so that the two edges come together above the strap 13 and flap 20. With the edges together, the mating fasteners are fastened to hold the liner securely in place during use. When it is desired to wash the liner, the liner is easily removed by unfastening the mating fasteners.

FIG. 5 shows another embodiment of the liner which is the same as the liner of FIGS. 3 and 4 except that end portions of the bottom edge have been smoothly curved, in substantially arc shape, to form concave bottom end portions 60 and 61. These bottom end portions extend outwardly toward bottom edge ends 27 or 28 from a bottom edge central portion 62 which extends between the bottom intermediate fastening means 51 and 52 and which is opposite the top edge central portion 35. This bottom edge central portion 62 may also be defined as extending between lines 53 and 55 of FIG. 4. It has been found that these curves on the bottom edge allow the liner to be more easily adjusted when installed to fit better around the strap 13 and flap 20. It also better accommodates the suspension mounting points 14 of the headgear.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A removable liner for lining a forehead-contacting portion of a headgear of a protective head covering such as a hard hat, comprising:

a piece of absorbent, cushioning material having a bottom edge with opposite ends, two substantially straight side edges extending upwardly and outwardly from the ends of the bottom edge to define bottom end corners and the ends of a top edge at the top of each side edge, a top edge having top edge end portions and a top edge central portion between the top edge end portions, said top edge end portions each sloping upwardly from the top edge ends to form top end corners and each having a rounded concave section sloping upwardly to meet the top edge central portion at top edge central portion ends, said top edge central portion being shorter than the top edge end portions;

end fastening means secured to the cushioning material adjacent the top end corners and bottom end corners whereby the bottom end corners can be secured to corresponding top end corners;

top intermediate fastening means positioned along the top edge central portion adjacent the top edge central portion ends; and bottom intermediate fastening means along the bottom edge intermediate the bottom end corners, said bottom intermediate fastening means being positioned within lines passing through the top intermediate fastening means perpendicular to the bottom edge.

2. A liner according to claim 1, wherein the absorbent, cushioning material is terry cloth.

3. A liner according to claim 1, wherein each side edge extends outwardly from the end of the bottom edge more than one inch.

4. A liner according to claim 3, wherein each side edge extends outwardly from the end of the bottom edge approximately one and one-eighth inches.

5. A liner according to claim 3, wherein the lines passing through the top intermediate fastening means pass through the center of the top intermediate fastening means.

6. A liner according to claim 5, wherein the bottom intermediate fastening means just touch respective lines, whereby each of the bottom intermediate fastening means is offset toward one another from respective top intermediate fastening means by one half the width of a fastening means.

7. A liner according to claim 6, wherein the bottom intermediate fastening means are offset with respect to respective top intermediate fastening means by approximately one-quarter inch.

8. A liner according to claim 6, wherein the bottom edge includes opposite bottom edge end portions extending between the ends of the bottom edge and a bottom edge central portion, and wherein the bottom edge end portions are concavely curved.

9. A liner according to claim 8, wherein the bottom edge central portion extends between the lines passing through the top intermediate fastening means.

10. A liner according to claim 1, wherein the lines passing through the top intermediate fastening means pass through the center of the top intermediate fastening means.

11. A liner according to claim 10, wherein the bottom intermediate fastening means just touch respective lines, whereby each of the bottom intermediate fastening means is offset toward one another from respective top intermediate fastening means by one half the width of a fastening means.

12. A liner according to claim 1, wherein the bottom edge includes opposite bottom edge end portions extending between the ends of the bottom edge and a bottom edge central portion, and wherein the bottom edge end portions are concavely curved.

13. A liner according to claim 12, wherein the bottom edge central portion extends between the lines passing through the top intermediate fastening means.

14. A liner according to claim 13, wherein the top edge central portion is substantially straight and parallel to the bottom edge central portion.

15. A liner according to claim 1, wherein the top edge central portion is substantially straight and parallel to an opposite bottom edge.

* * * * *